United States Patent [19]

Getchell

[11] 4,004,319

[45] Jan. 25, 1977

[54] DRAPERY HOLDER

[76] Inventor: F. Grant Getchell, 570 Antelope Way, Eugene, Oreg. 97401

[22] Filed: July 21, 1975

[21] Appl. No.: 597,475

[52] U.S. Cl. ..... 16/93 D; 24/263 PJ; 211/46; 211/124

[51] Int. Cl.[2] ..... A47H 15/00

[58] Field of Search ..... 16/93 D, 94 D, 95 D, 16/96 D; 24/263 PJ, 263 P, 263 R; 292/306; 160/348; 211/43, 46, 89, 124

[56] References Cited

UNITED STATES PATENTS

| | | | |
|---|---|---|---|
| 903,302 | 11/1908 | Moore | 248/246 UX |
| 3,171,542 | 3/1965 | Jacobs et al. | 24/263 PJ UX |
| 3,343,683 | 9/1967 | Wheeler | 211/124 X |
| 3,695,256 | 10/1972 | Brower | 248/226 B X |
| 3,823,855 | 7/1974 | Dohring | 211/89 X |

*Primary Examiner*—Werner H. Schroeder
*Assistant Examiner*—Moshe I. Cohen
*Attorney, Agent, or Firm*—James D. Givnan, Jr.

[57] ABSTRACT

A drapery support for temporary drapery engagement during cleaning and pressing operations. A horizontal support receives a quantity of drapery engaging members with one of said members being slidable into cooperating successive engagement with drapery pleats. The drapery engaging members are self-locking by reason of the reaction force exerted by a clamped drapery. To release the drapery, the drapery engaging member is actuated by finger-tip pressure to disengage abutting surfaces on the support member and said drapery engaging member.

1 Claim, 4 Drawing Figures

3
2
2
15
5
5
5
5
1
4
4
4
4
8
7
8
7
8
7
8
7
8
7
8
7
6
6
6
6
D 5
11
10
13
12
14
4
8
7

5
11
1
13
14
12
12
4
4
4
4
D
8
8
7

7
12
8
7
12
8
D

DRAPERY HOLDER

BACKGROUND OF THE INVENTION

The present invention relates generally to a device for supporting curtains or draperies while the same are being worked with during cleaning and pressing operations.

During the cleaning and pressing of draperies it is highly desirable that the drapery be temporarily supported at its upper end for purposes of conveniently handling same. Known drapery holders are provided with a number of hinged clamps which must be individually sprung open while the drapery is inserted intermediate the clamping members. Conversely, drapery removal again entails similar independent operation of each of the several drapery-engaging clamps. Temporary drapery holders as used in cleaning and pressing establishments are awkward to operate, do not always firmly grip the drapery and are susceptible to becoming entangled with or snagging the drape. Further, drapery holders relying on spring-biased components are susceptible to loss of spring tension over a period of time requiring servicing or replacement of the holders to prevent drapery separation during a cleaning or pressing operation.

SUMMARY OF THE PRESENT INVENTION

The present invention is embodied within a drapery holder having a multitude of drapery engaging members slidably disposed on a common support with said members adapted for positive rapid engagement with a drapery during a drapery mounting operation. Similarly, disengagement of said member is accomplished in an expeditious manner by simple one finger actuation of the drapery engaging member. The present holder includes an elongate support with a series of drapery engaging members disposed thereon which are advanced individually into successive contact with the drapery adjacent each of the drapery pleats. The novel configuration of the drapery engaging members assures the same being held in place against the opposing biasing action of a clamped drapery segment. Release of each of said members is accomplished by finger-tip actuation which disengages abutting surfaces. The drapery engaging members function in a joint manner in that each is slidable into drapery engagement against a previously positioned member which serves to provide an abutment against which the curtain or drapery folds are clamped. Edges formed on each clamping member engage the elongate support to resist dislodgement. The drapery clamping member is accordingly locked in place until such time as the operator imparts a momentary pressure to the upper end of the clamping member to unlock same from its support member.

Important objects of the present invention include the provision of a holder readily engageable with curtains or drapes to provide a rigid carrier facilitating handling of the drapes or curtains; of a holder readily adaptable to various curtain or drapery sizes; of a holder manually operated by finger-tip pressure alone having no springs or intricate operating mechanism to malfunction or become snagged with the drape; and of a drapery holder of simplified construction having low original cost and one highly reliable in operation.

DETAILED DESCRIPTION OF PREFERRED EMBODIMENTS

Figures 1, 2, 3, 4:
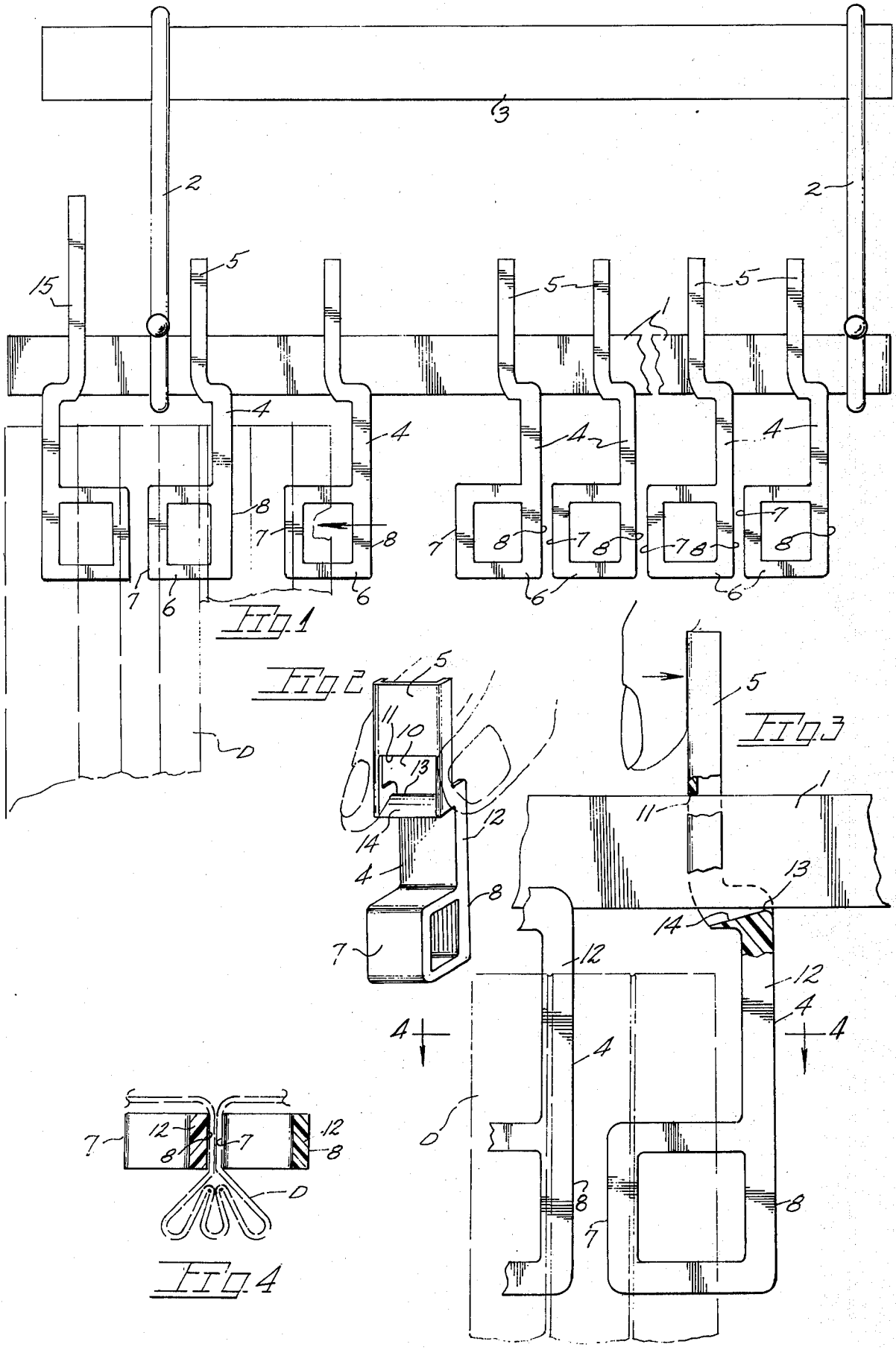
FIG. 1 is a front elevational view of the present drapery holder sectioned for purposes of illustration and shown supporting a drapery in phantom lines.
FIG. 2 is a perspective view of a drapery engaging member with the thumb and index finger of an operator shown actuating said member for drapery engaging movement along a support member.
FIG. 3 is an elevational view of a fragment of the support member with drapery clamping members thereon with the clamping member being actuated toward a release position by the operator's finger.
FIG. 4 is a horizontal section taken downwardly along line 4—4 of FIG. 3 showing the drapery clamping members in operative engagement with a segment of drapery.

With continuing reference to the drawings wherein applied reference numerals indicate parts similarly identified in the following description, the reference numeral 1 indicates an elongate support of the present invention adapted for suspension by hangers 2 from a rack or other horizontal means at 3, not part of the present invention. Hanger elements 2 terminate downwardly in hooked engagement, which may be in either temporary or permanent securement with support member 1.

Spaced apart along support member 1 are a series of drapery engaging clamping members 4 each having an upwardly projecting end 5 for finger-tip actuation as later described. The lower portion of each drapery clamp 4 is embodied within an enlarged portion 6 having drapery engaging walls 7 and 8. With attention to FIGS. 2 and 3 the upper portion 5 of each drapery clamp defines an opening 10 for reception of elongate support 1. In line contact with the upper surface of support member 1 is a clamp edge 11 which as later described constitutes an axis about which the drapery clamp is biased by the reaction force exerted by a clamped drapery. An offset segment of the clamp is indicated at 12 which terminates upwardly in an edge 13 which also is adapted for abutting engagement but with the underside of support 1. The line contact along edge 13 provides an axis for clamp movement during release. Inclined downwardly from edge 13 is a surface area 14 which enables the drapery clamp to be inclined relative to horizontal support member 1 enabling subsequent shifting of clamp 4 along said member during a drapery releasing operation.

In place on support 1 adjacent one end thereof is a backstop member 15 which may be of generally similar configuration to drapery clamps 4 for reasons of convenience or alternately may be integral with support member 1 in a permanent manner.

In a drapery loading operation the drapery pleats are installed within the hanger with the folded pleat portion projecting forwardly as viewed in FIG. 4 from a pair of clamps 4. Clamping of the drapery in such a manner permits proper finishing of the drapery without disfigurement or disarrangement of the drapery or curtain pleats. With the folded drapery held in place, the drapery clamp 4 is grasped as shown in FIG. 2 and slid along support member 1 until wall 7 thereof is in firm abutting engagement with the folded drapery material. The remaining clamps are slid in succession into place adjacent each pleat. The folded drapery material will bias the clamp and particularly edge 13 thereof into locking abutment with the underside of support member 1 to lock same in place on said support member. Any biasing of clamping member 4 will be about an axis extending substantially along upper edge 11 of said opening. One wall 7 of one clamping member biases the clamped drapery against wall member surface 8 of an adjacent clamp member.

With attention to FIG. 3, release of the clamping members may be accomplished very rapidly simply by exerting finger-tip applied pressure in the direction of the applied arrow. The pressure so applied permits the drapery clamp to move away from the drapery by reason of edge 13 of the clamp being rotated out of forceful contact with the underside of support member 1. Accordingly, the drapery clamps are released from right to left in FIG. 1 and ultimately the last clamping member cooperating with backstop member 15 is disengaged from the drapery.

While I have shown but one embodiment of the invention it will be apparent to those skilled in the art that the invention may be embodied still otherwise without departing from the spirit and scope of the invention.

Having thus described the invention what is desired to be secured under a Letters Patent is:

1. A drapery holder for temporary supporting engagement with the folds of a drapery, said holder comprising in combination, an elongate support having upper and lower surface areas, a series of drapery engaging members in slideable engagement with said support, each of said members having an elongate upper portion and an enlarged bottom portion with upright drapery engaging surfaces on said bottom portion cooperating with like surfaces on adjacent like members to clamp drapery folds therebetween, each of said upper positions of said drapery engaging members further having an opening defined by diagonally offset upper and lower edges for contact with the upper and lower surfaces of said elongate support, said opening also defined by a downwardly inclined surface area continguous with said lower edge, reaction forces exerted in one direction by a clamped drapery fold on the lower portion of a member causing said lower edge of same to rotate about said upper edge into locked engagement with the lower surface of said support while conversely finger-tip pressure applied to the upper portion of the holder will release said lower edge permitting drapery releasing movement of the drapery engaging member along the elongate support.

* * * * *